US006567343B1

(12) United States Patent
Purcell et al.

(10) Patent No.: US 6,567,343 B1
(45) Date of Patent: May 20, 2003

(54) FLEXTENSIONAL RESONANT PIPE PROJECTOR

(75) Inventors: Christopher John A. Purcell, Dartmouth (CA); Richard A. Fleming, Prince Edward Island (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 0 days.

(21) Appl. No.: 10/172,009

(22) Filed: Jun. 17, 2002

(51) Int. Cl.[7] ..... H04R 17/10; H04R 17/00

(52) U.S. Cl. ..... 367/176; 367/157; 367/162; 367/165; 310/337

(58) Field of Search ..... 367/150, 153, 367/155, 159, 163, 166, 174, 176, 162, 165; 310/337; 181/177, 182, 189, 192, 196, 180

(56) References Cited

U.S. PATENT DOCUMENTS 3,848,226 A * 11/1974 Perez ..... 294/66.1
3,872,421 A * 3/1975 Rogers et al. ..... 310/322
4,855,964 A * 8/1989 Fanning et al. ..... 310/337
4,922,470 A * 5/1990 McMahon et al. ..... 310/337
5,047,997 A 9/1991 Forsberg
5,062,089 A 10/1991 Willard et al.
5,119,343 A * 6/1992 Katahara ..... 181/106
5,136,556 A * 8/1992 Obara ..... 310/337
5,289,436 A * 2/1994 Terhune ..... 181/400
5,315,917 A * 5/1994 Mayzes ..... 367/120
5,493,815 A * 2/1996 Belser et al. ..... 49/377
5,805,529 A * 9/1998 Purcell ..... 367/163

FOREIGN PATENT DOCUMENTS

CA 1319414 9/1988

* cited by examiner

*Primary Examiner*—Ian J. Lobo
(74) *Attorney, Agent, or Firm*—Larson & Taylor, PLC

(57) ABSTRACT

An underwater acoustic projector comprising a pair of spaced apart end walls with an acoustic driver positioned between the end walls, the driver having smaller cross-sectional dimensions than the end walls. The projector has a one piece thin wall inwardly concavely shaped shell with corrugations running in the axial direction surrounding the driver and mechanically coupled to the end walls. An open ended tubular waveguide (pipe) is connected to each end wall of the projector and extend outward forming a flextensional resonant pipe projector.

20 Claims, 5 Drawing Sheets

FLEXTENSIONAL RESONANT PIPE PROJECTOR

FIELD OF THE INVENTION

The present invention relates to acoustic projectors, especially projectors for use in military and civilian sonar having more bandwidth than previous folded shell acoustic projectors.

BACKGROUND OF THE INVENTION

Military and civilian sonar systems require compact, light weight, high power, efficient, wide bandwidth acoustic projectors whose performance is stable with depth and linear with drive voltage levels.

Canadian Patent 1,319,414 by Bryce Fanning et al that issued on Jun. 22, 1993 describes one type of a free-flooding piezoelectric driven resonate-pipe projector (RPP) with vent holes in the pipe walls to broaden the response of certain cavity resonances and to increase the response between those resonances. The drive unit is a radially-poled lead zirconate-titanate cylinder with aluminum pipes extending into the center of the piezoelectric drive unit, the pipes being mechanically coupled to the drive unit. Accomplishing the necessary acoustic coupling between the drive unit and pipes requires a close mechanical fit to couple the drive unit to the pipes. These resonant pipe projectors are partially free-flooding and can be operated at extreme depths because the drive unit is highly resistant to hydrostatic loading. However, the bandwidth is small and they are expensive to manufacture due to the close tolerances required.

Flextensional projectors are amongst the best ones presently available to meet military and civilian sonar systems requirements, one known flextensional projector being the barrel stave type. The barrel stave projector (BSP) is a compact, low frequency underwater sound source which has applications in low frequency active (LFA) sonar and in underwater communications. In one known BSP design, such as described in U.S. Pat. No. 4,922,470 by G. McMahon et al, a set of curved bars (staves) surround and enclose a stack of axially poled piezoelectric rings located between end walls to which the staves are attached. The staves act like a mechanical transformer and help match the impedance of the transducer to the radiation impedance of the water. Axial motion of the stave ends is transformed to a larger radial motion of the stave midpoints. This increases the net volume velocity of the water, at the expense of the applied force, and is essential for radiating effectively at low frequencies.

This known BSP projector has slots between the staves which are required to reduce the hoop stiffness and achieve a useful transformer ratio. However, these slots must be waterproofed by a rubber membrane (boot) stretched tightly and glued with epoxy around the projector. This boot also provides effective corrosion protection for the A1 staves. However, the variation in performance with depth of the BSP is suspected to depend in part on the boot. At increasing depths, hydrostatic pressure pushes the boot into the slots causing the shell to stiffen tangentially, increasing the resonance frequency, and causing an increasing loss of performance. This depth sensitivity of a barrel stave projector can be reduced somewhat by reinforcing the boot over the slots. It is also possible to pressure compensate the BSP with compressed air or other gas. The pressurized gas increases the stiffness of the projector and hence raises its resonant frequency.

The slots in the BSP, as a secondary effect, provide a nonlinearity in the response of the projector to hydrostatic loading. The staves will deflect inwards together under increasing hydrostatic loading (assuming no pressure compensation) since the projector is air filled. Depending on the thickness and stiffness of the rubber, it is reasonable to expect that as the slots close at great enough depths, that closure of the slots due to increasing depth will force the boot back out of the slots. The projector will now be very stiff and resistant to further effects of depth until the crush depth of the now, effectively, solid shell is reached. This provides a safety mechanism which may save the projector in case an uncompensated BSP is accidentally submerged very deep or a pressure compensation system runs out of air.

Variants of this known BSP have been built to optimise light weight, wider bandwidth, low frequency, high power, and improved electroacoustic efficiency. Efficiency is an especially critical parameter for the high power versions of the BSP because the driver is well insulated from the water thermally. The boot's relatively poor thermal conductivity contributes to the difficulty in cooling the BSP.

Overhaul of a barrel stave projector usually involves a costly boot replacement.

The inside surfaces of the (eight) staves of these BSPs are machined individually from bar stock on a numerically controlled (NC) milling machine. The staves are then mounted together on a fixture and the outside surfaces are turned on a tracer lathe. The machining and handling costs are such that the staves are the most expensive parts of the BSP. These BSPs are, as a result, both relatively costly to manufacture and maintain.

The BSP suffers from variation of performance with depth caused by water pressure forcing the rubber membrane into the slots between the vibrating staves of the projector unless a pressure compensation system is fitted. The BSP shows nonlinearity of performance versus drive voltage due to effects of the rubber membrane. Thus there could be substantial advantages to accrue if it were possible to develop a one-piece flextensional shell for the BSP that does not require a boot.

A one-piece flextensional shell projector is described by Christopher Purcell in U.S. Pat. No. 5,805,529. The surface of this projector is formed of a thin-walled one-piece inwardly concavely shaped shell containing corrugations (folds) running in the axial direction. This one-piece shell is slotless which eliminates the requirement for a boot.

SUMMARY OF THE INVENTION

It is an object of the invention to provide an acoustic folded shell projector with improved bandwidth.

An acoustic projector, according to one embodiment of the present invention, comprises a pair of spaced apart end walls with an acoustic driver positioned between and connected to the end walls, the driver having smaller cross-sectional dimensions than the end walls, at least one end wall having a tubular pipe waveguide extending outwardly from that end wall, outer ends of the pipes being open, the projector having a thin-walled one-piece inwardly concavely shaped shell containing corrugations running in the axial direction surrounding the driver, the shell being mechanically connected to the end walls.

BRIEF DESCRIPTION OF THE DRAWINGS

The invention will now be described in more detail with reference to the accompanying drawings, in which.

DESCRIPTION OF THE PREFERRED EMBODIMENTS

Military and civilian sonar systems require compact, light weight, high power, efficient, wide bandwidth acoustic projectors whose performance is stable with depth and linear with drive voltage levels as well as being low in cost to manufacture and maintain.

Flextensional projectors are amongst the best ones presently available to meet the requirements for military and civilian sonar systems. One type of flextensional projector, known as the barrel stave projector (BSP), is described in U.S. Pat. No. 4,922,470 by G. W. McMahon et al. In this BSP, a set of inwardly curved aluminium bars surround a stack of axially poled piezoelectric rings that form an acoustic driver, the bars being separated by slots and surrounded by a waterproof boot, ends of the bars being mechanically connected to spaced apart end walls to which the driver is coupled, the driver having smaller cross-sectional dimensions than the end walls.

Figure 1:
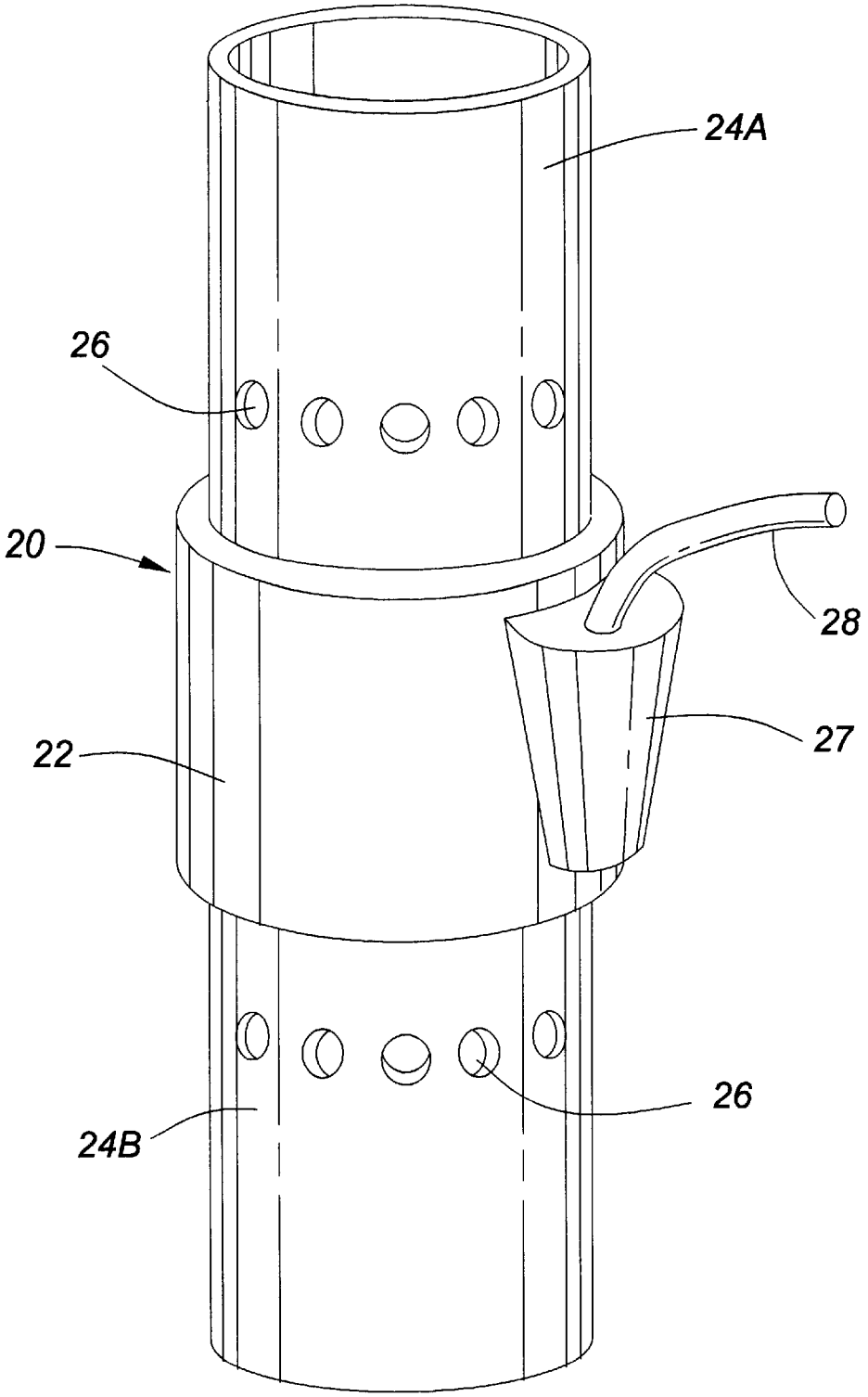
PRIOR ART FIG. 1
FIG. 1 is a perspective view of a known resonant pipe projector.

Canadian Patent 1,319,414 by Bruce Fanning et al which issued on Jun. 22, 1993 describes one known type of a partially free-flooding piezoelectric driven resonate pipe projector (RPP) which is illustrated in FIG. 1. This RPP 20 contains vent holes 26 in the pipe walls 24A and 24B to broaden the response of certain cavity resonances and to increase the response between those resonances. The drive unit 22 is a radially-poled lead zirconate-titanate cylinder with the aluminum pipes 24A and 24B extending into that cylinder where they are mechanically coupled to the inner surface of the drive unit. To accomplish the necessary acoustic coupling between the drive unit 22 and the pipes requires a close mechanical fit between those parts. This type of RPP is partially free-flooding and can be operated at extreme depths since the drive unit is highly resistant to hydrostatic loading. However, its bandwidth is small and it is expensive to manufacture due to the close mechanical tolerances required.

An axial drive resonant pipe projector (ADRPP) described in co-pending Canadian Application No. 2,357,605, which corresponds to U.S. application Ser. No. 09/957,454 is a partially free-flooding acoustic projector that can be operated at extreme depths because the piezoelectric drive unit is highly resistant to hydrostatic loading. This ADRPP has a balanced pair of free flooded pipes (waveguides) with open ends and integral end walls connected to a piezoelectric drive unit with pre-stress rods holding the end plates against the drive unit. This ADRPP is lightweight, compact and inexpensive to manufacture because the drive motor does not have to precisely fit the outside circumference of a resonant pipe as required in other RPPs such as those described in Canadian Patent 1,319,414.

Figure 2:
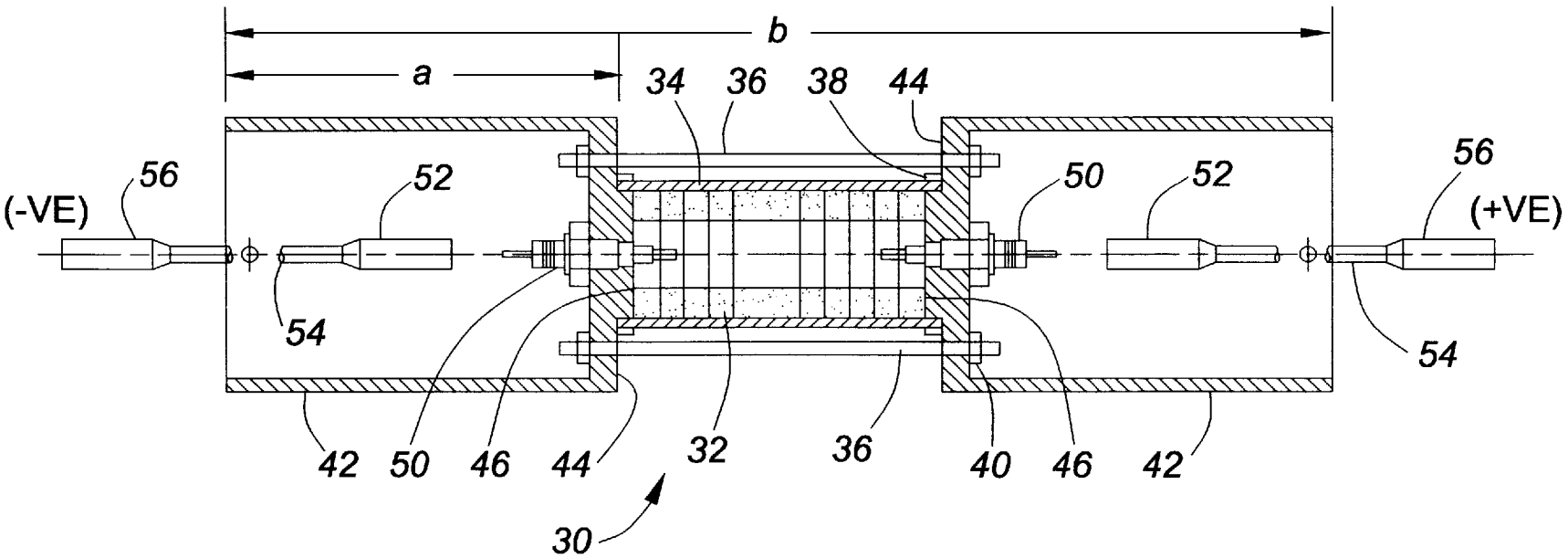
PRIOR ART FIG. 2
FIG. 2 is a cross-sectional view of an acoustic resonant pipe projector described in a co-pending application.

The axial drive resonant pipe projector 30 illustrated in cross-section in FIG. 2 and described in that co-pending Canadian Application contains a 12 ring ceramic stack piezoelectric drive element 32, the rings having nominal dimensions of 2 inch outer diameter, 0.4 inch axial length and 0.505 inch wall thickness. To water-tight seal the stack 32 from sea-water, a 0.075 inch thick neoprene boot 34 was used to isolate the active components and it is bonded to the stack 32 by restraining clamps 38 clamped on the central boss 46 of the end plates 44 at either end of the stack 32. An alternative to the neoprene boot is that one or more drive motors may be waterproofed by a coating. Although a stack of 12 ceramic rings are shown in FIG. 2, that number may be varied or a single piezoelectric cylinder used.

The waveguides 42 at opposite ends of the stack 32 consists of tubular pipe waveguides with open ends facing away from stack 32 and integrally formed end walls 44, each end-wall having a central boss 46 that presses against the ends of stack 32. That boss 46 serves a dual purpose in that (1) it serves to increase the wall thickness to maintain peak operational bending stresses in the end-wall below the endurance limit of the aluminum end wall and (2) it facilitates the water-tight sealing of the neoprene boot 34 to stack 32. The end-walls 44 are shown as being integrally formed with the tubular pipes but these could be formed separately and the central bosses 46 would not be necessary when the drive element is waterproofed with a coating rather than a boot.

The projector described in that co-pending Canadian Application No. 2,357,605, which corresponds to U.S. application Ser. No. 09/957,454, is lightweight, compact and inexpensive to manufacture compared to other projectors. The tuning of the longitudinal mode of this projector may be achieved by varying the length of the waveguides, the length of the motor, the end plate dimensions and the material properties. To lower the frequency of the operational band, low sound speed fluids may be sealed into the waveguide volumes by means of a flexible membrane covering their ends. The projector does have a narrow bandwidth but narrow band projectors are relative easy to power efficiently and, therefore, are highly suited to low cost battery operated expendable applications where a highly efficient sonar system (including amplifier, transformer and projector) is required.

A folded shell projector (FSP) (illustrated in FIG. 3) relies upon a mechanical transformer ratio to amplify axial motion into radial motion by taking advantage of the curved sides of the projector. At its lowest breathing mode, the radial motion of this projector is in phase with the axial drive motion. The mechanical transformer ratio (ratio of radial motion to axial motion) of this transducer increases its fluid volume displacement and typical transformer ratios are in the range of 2 to 5.

Figure 3:
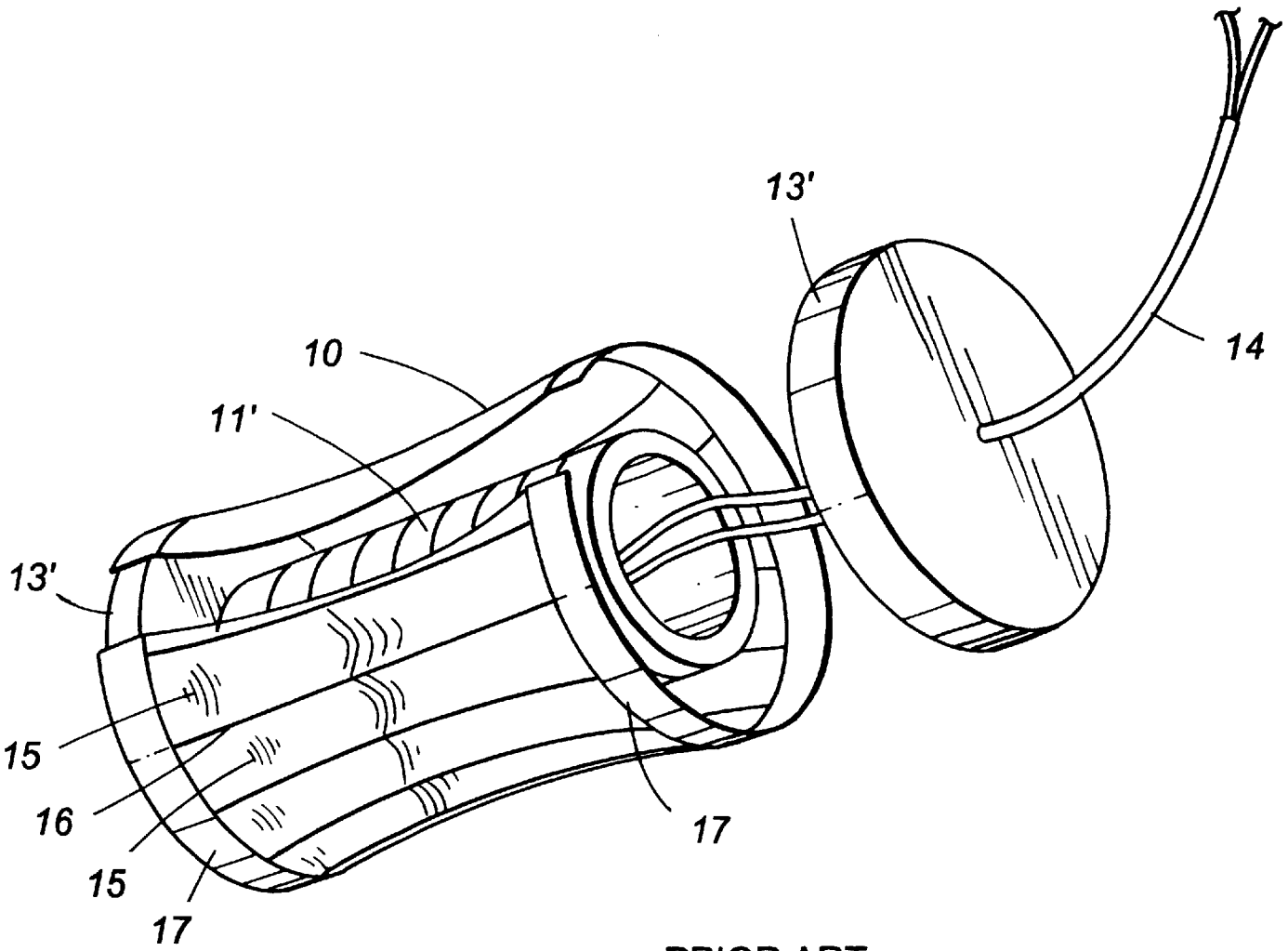
PRIOR ART FIG. 3
FIG. 3 is a perspective view of a known folded shell projection with one fold cut away to show the drive motor.

One folded shell projector flextensional acoustic projector is described by Christopher Purcell in U.S. Pat. No. 5,805,529 and it is illustrated in FIG. 3. This projector has a one-piece slotless flextensional shell 10 for an underwater acoustic projector which is inwardly concavely shaped similar to the BSP but which does not require any boot. The one-piece shell 10 has no gaps or openings in its outer surface. This shell achieves the required low hoop stiffness for low frequency operation by using folds 15 rather than slots as used in the BSP. This Folded Shell Projector's (FSP) surface is formed of a thin-walled one-piece inwardly concavely shaped shell containing corrugations (folds) 15 running in the axial direction. The corrugations extend between end flanges 17 which are connected to end walls $13^1$. Leads extend from a piezoelectric driver $11^1$ through a central opening in one of the end walls $13^1$. The thin shell 10 provides a waterproof enclosure for the driver in this type of projector but tight tolerances are required during the manufacture of this projector.

Figure 4:
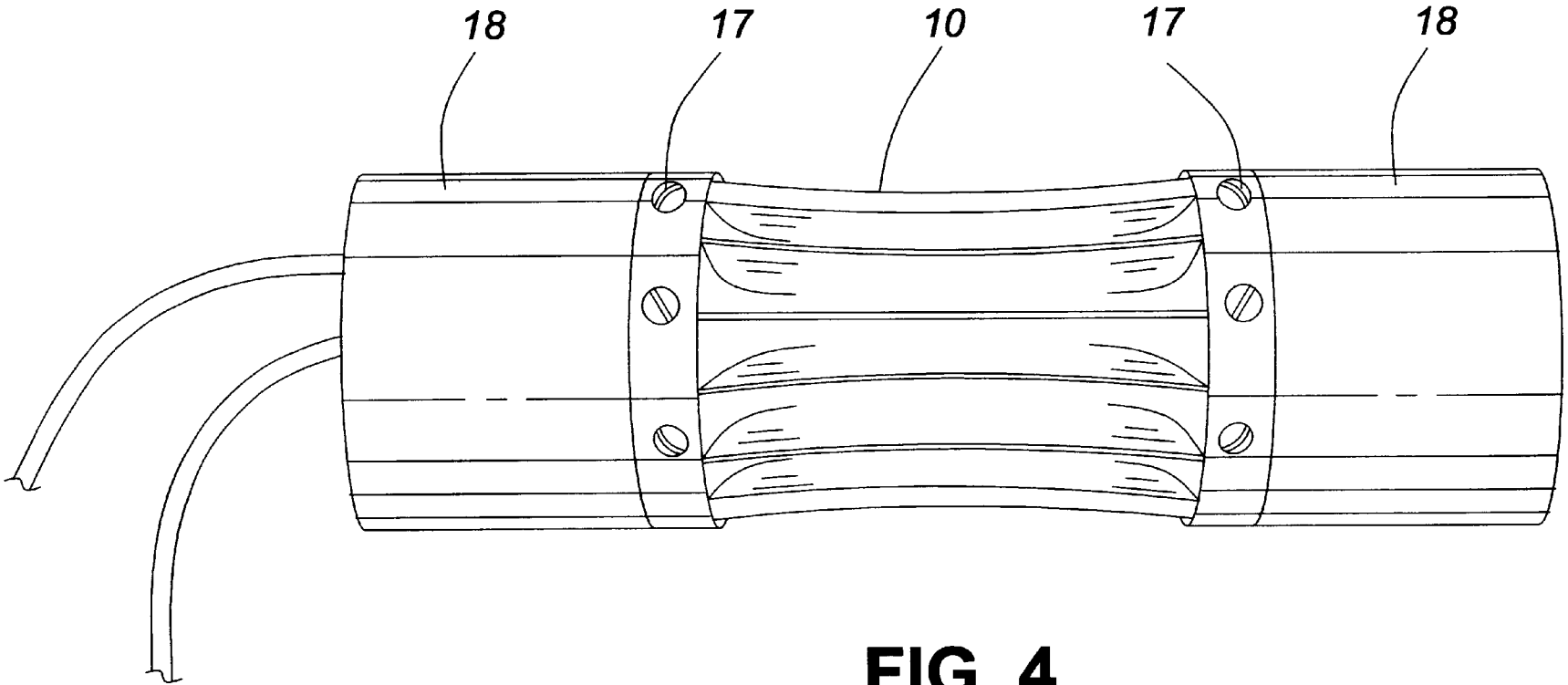
FIG. 4 is a perspective view of a flextensional resonant pipe projector (FRPP) according to one embodiment of the present invention, FIG. 5 contains graphs showing the frequency response of a folded shell projector and the FRPP according to the invention, and FIG. 6 contains graphs showing the frequency response deviation of the FRPP between the horizontal TVR (transmitting voltage response) and the end-fire TVR's.

The first breathing mode frequency of the folded shell projector (FSP number 30X30-1) is approximately 2 kHz with a bandwidth of 500 Hz. A second resonance introduced near 3.5 kHz could, however, increase the bandwidth of the device. To accomplish this, advantage could be taken of the first resonance seen in the ADRPP and this is illustrated in FIG. 4 where open ended aluminium pipe waveguides 18 are attached to the end walls $13^1$ of the folded shell projector 10 with high strength epoxy. Waveguides may be formed of other materials such as polyvinyl chloride (PVC) tubing.

An aluminium open end pipe waveguide 0.0762 m long, 0.06985 m inside diameter and 0.00635 m wall thickness was attached to each end of folded shell projector as illustrated in FIG. 4 to form a prototype Flextensional Resonant Pipe Projector (FRPP). The attached aluminium pipe waveguides were coated with 3 layers of neoprene paint to eliminate galvanic corrosion which, otherwise, would occur between the aluminium waveguides 18 and the nickel shell of projector 10.

The calculated waveguide resonance was 3342 Hz as derived by the following tube wave speed formula:

$$f = \frac{c(1 + 2r\rho c^2/(Et))^{-1/2}}{4(L + 0.58r)} \quad (1)$$

In this equation, c is the speed of sound in water, r is the inside radius of the pipe, ρ is the density of the water, E is the modulus of elasticity of the pipe and t is the wall thickness of the pipe.

Figure 5:
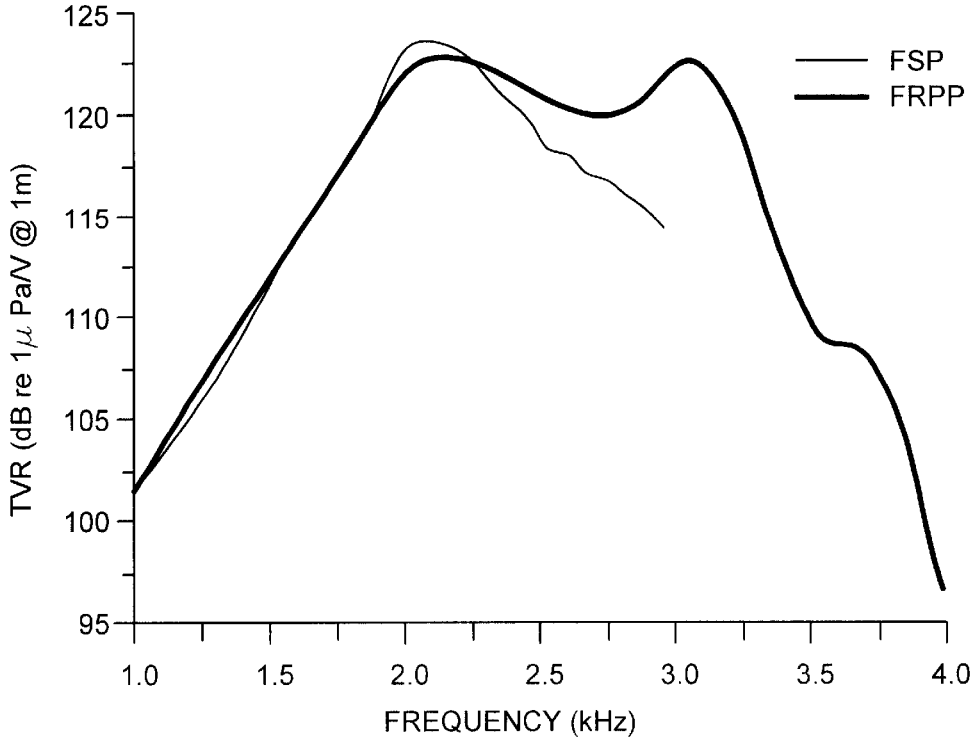

The measured performance of the prototype FRPP showed that the device had a bandwidth of 1600 Hz at −6 dB down points with no appreciable loss in source level from the original folded shell projector (FSP) which had a 500 Hz bandwidth. This is illustrated by the graphs in FIG. 5 where the transmitting voltage response (TVR) is plotted against frequency for both the FRPP and FSP.

Figure 6:
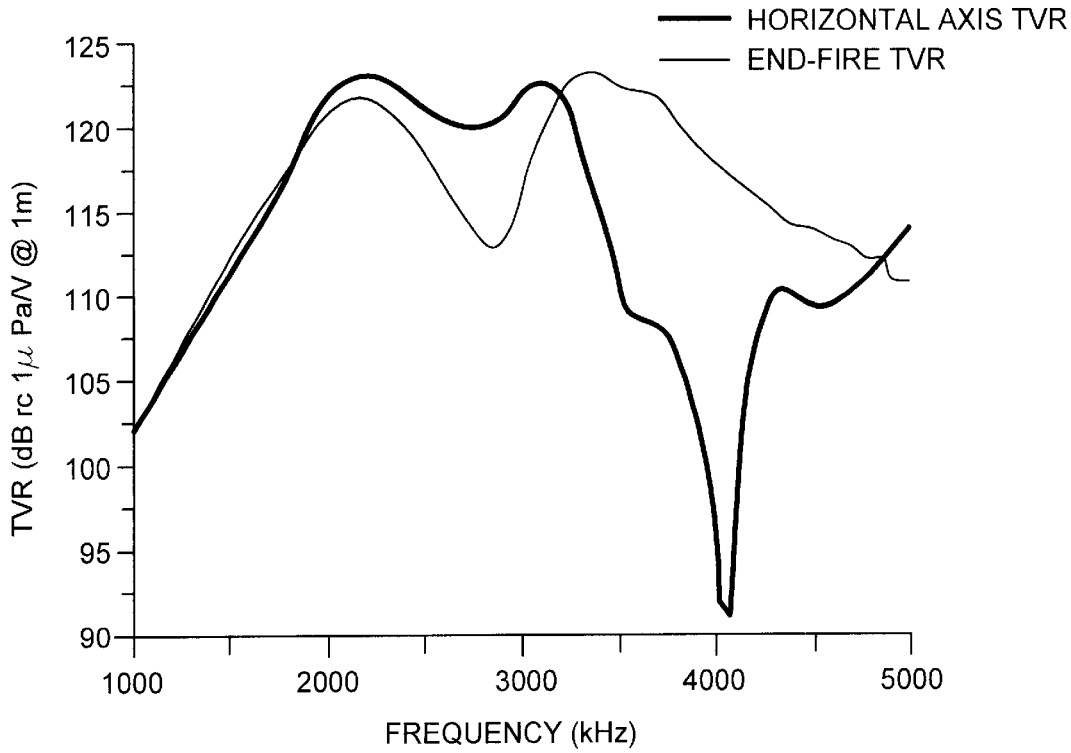

The phase of the wave emanating from the waveguides was, however, not optimized with respect to the wave from the surface of the folded shell portion of the FRPP. Therefore, directional behaviour of the device was noted throughout its operating band. This directional behaviour is illustrated by the graphs in FIG. 6 which show the deviation between the measured horizontal TVP and the end-fire TVR's of the FRPP. These acoustic projectors may be used in a medium other than water, such as in air as a loudspeaker.

A single waveguide could be applied to only one end of the flextensional projector, with less benefit than application to both ends, but still producing a gain in bandwidth. This configuration can be used when one end of the flextensional projector is fixed to an inertial mass, or otherwise occupied in a secondary use (mounting a transformer or serving as an attachment point). The waveguides can also be applied to a barrel stave projector, as well as the FSP, with a resulting increase in bandwidth.

Various modifications may be made to the described embodiment without departing from the spirit and scope of the inventions as defined in the appended claims. The ends of the waveguides, for instance, could be flared to form a conical or horn shape with a larger cross-sectional area at the outer end of the waveguide. The flared shape would decrease the first and third resonance frequency while the second resonance frequency would increase. The third resonant mode is a breathing mode and its frequency will drop due to the increased mass loading of the water. This is a consequence of the altered relative direction of motion of the waveguide to the water. The waveguides may also be sealed at their outer ends by thin flexible polymer membranes and filled with a fluid having a lower sound speed than the surrounding medium such as a fluorosilicone oil to lower the resonance frequency.

The embodiments of the invention in which an exclusive property or privilege is contained is claimed are defined as follows:

1. An acoustic projector comprising a pair of spaced apart end walls with an acoustic piezoelectric driver positioned between and mechanically coupled to the end walls, the driver having smaller cross-sectional dimensions than the end walls, at least one end wall having a tubular pipe waveguide extending outwardly from the driver with an outer end of the pipe being open, the projector having a thin-walled one-piece inwardly concavely shaped shell containing corrugations running in the axial direction surrounding the driver, the shell being mechanically connected to the end walls.

2. An acoustic projector as defined in claim 1, wherein said at least one end wall, the shell and waveguide are metallic.

3. An acoustic projector as defined in claim 2, wherein the piezoelectric driver is a stack of piezoelectric rings and the shell is connected to each of the end walls in a water proof manner.

4. An acoustic projector as defined in claim 3, wherein the waveguide has a different material composition than the shell, the waveguide being coated with a material to prevent galvanic corrosion.

5. An acoustic projector as defined in claim 3, wherein the waveguide has a different material composition than the shell, the waveguide being made from a material that avoids galvanic corrosion.

6. An acoustic projector as defined in claim 5, wherein the end of the waveguide is flared to form a conical shape with a larger cross-sectional area at an outer end of the waveguide.

7. An acoustic projector as defined in claim 1, wherein each end wall has a tubular pipe waveguide extending outwardly from the driver.

8. An acoustic projector comprising a pair of spaced apart end walls with an acoustic piezoelectric driver positioned between and mechanically coupled to the end walls, the driver having smaller cross-sectional dimensions than the end walls which have tubular pipe waveguides extending outwardly from the driver, outer ends of the waveguides being sealed with a polymer membrane with the waveguides being filled with a fluid having a lower sound speed than the surrounding medium, the projector having a thin-walled one piece inwardly concavely shaped shell containing corrugations running in the axial direction surrounding the driver, the shell being mechanically connected to the end walls.

9. An acoustic projector as defined in claim 8, wherein the driver is a stack of piezoelectric rings and the shell is connected to each end wall in a waterproof manner.

10. An acoustic projector as defined in claim 9, wherein the waveguides have a different metallic composition than the shell, the waveguides being coated with a material to prevent galvanic corrosion.

11. An acoustic projector as defined in claim 10, wherein the waveguides are aluminium waveguides coated with neoprene paint.

12. An acoustic projector as defined in claim 8, wherein the ends of the waveguides are flared to form a conical shape with outer ends of the waveguides having a larger circumference than inner ends of the waveguides.

13. An acoustic projector comprising a pair of spaced apart end walls with an acoustic piezoelectric driver positioned between and mechanically coupled to the end walls, the driver having smaller cross-sectional dimensions than the end walls, a set of inwardly curved metallic bars surrounding the acoustic driver, which bars are separated by slots and surrounded by a waterproof boot, ends of the bars being connected to the end walls which have tubular pipe waveguides extending outwardly from the driver.

14. An acoustic projector as defined in claim 13, wherein the driver is a stack of axially poled piezoelectric rings.

15. An acoustic projector as defined in claim 1, wherein each end wall has a tubular pipe waveguide extending outward from the driver with an outer end of the pipe being open.

16. An acoustic projector as defined in claim 15, wherein shell and waveguides are metallic.

17. An acoustic projector as defined in claim 16, wherein the piezoelectric driver is a stack of piezoelectric rings and the shell is connected to each of the end walls in a water proof manner.

18. An acoustic projector as defined in claim 17, wherein the waveguides have a different material composition than the shell, the waveguides being coated with a material to prevent galvanic corrosion.

19. An acoustic projector as defined in claim 17, wherein the waveguides have a different material composition than the shell, the waveguides being made from a material that avoids galvanic corrosion.

20. An acoustic projector as defined in claim 16, wherein the ends of the waveguides are flared to form a conical shape with a larger cross-sectional area at outer ends of the waveguides.

* * * * *